United States Patent [19]

Ury et al.

[11] 4,363,270

[45] Dec. 14, 1982

[54] HARMONIC PHASING DEVICE FOR PRINTING PRESS

[75] Inventors: Frank Ury, Olpe; Howard L. Propheter; Carlton A. Bird, both of Emporia, all of Kans.

[73] Assignee: Didde Graphic Systems Corporation, Emporia, Kans.

[21] Appl. No.: 190,272

[22] Filed: Sep. 24, 1980

[51] Int. Cl.[3] ..... B41F 5/06; B41F 13/14

[52] U.S. Cl. ..... 101/180; 101/181; 101/248

[58] Field of Search ..... 101/248, 181, 183, 177–180, 101/137, 138, 142, 143, 220; 74/640, 395, 396, 397, 398, 399, 675

[56] References Cited

U.S. PATENT DOCUMENTS

| | | | |
|---|---|---|---|
| 2,906,143 | 9/1959 | Mussier | 74/640 |
| 3,306,188 | 2/1967 | Couzens et al. | 101/248 X |
| 3,565,006 | 2/1971 | Stewart | 74/640 X |
| 3,724,368 | 4/1973 | Treff | 101/248 |
| 4,072,104 | 2/1978 | Schaffer | 101/248 |

OTHER PUBLICATIONS

"Harmonic Drive Pancake Gearing", No. HDU Floco-76, USM Corporation, Woburn, Mass.

*Primary Examiner*—J. Reed Fisher

*Attorney, Agent, or Firm*—Schmidt, Johnson, Hovey & Williams

[57] ABSTRACT

A dual harmonic gear phasing device forming a part of a web-forming printing tower or other web-handling station is disclosed which allows static or dynamic, 360° infinite phase alterations of web-contacting rollers for coarse and fine tuning of the registration of a multiple-station printing press. The phasing device comprises an enclosed, oil filled structure having a pair of tandem coupled harmonic drive gears respectively connected through gearing or the like to the press drive and to a desired roller for phase changing purposes. Each phasing device also includes a selectively operable stepper motor coupled to one of the harmonic gears for effecting phase alterations. The harmonic gears serve as a 1:1 gear ratio transmission during normal running operations. The phasing device can be used on hard impression or perfecting printing towers, and on other types of web-handling equipment where proper registration is important, such as numbering and punching units.

8 Claims, 7 Drawing Figures

HARMONIC PHASING DEVICE FOR PRINTING PRESS

BACKGROUND OF THE INVENTION

1. Field of the Invention

The present invention is concerned with an improved harmonic phasing device adapted for installation on a variety of web-handling stations such as printing presses or similar equipment, in order to permit selective adjustment of the angular or circumferential disposition of one or more of the web-engaging rollers associated with such equipment. More particularly, it is concerned with a phasing unit preferably in the form of a compact, self-contained, dual harmonic gear unit which serves as a drive transmission during normal operating conditions, and includes a selectively operable stepper motor which can be actuated for circumferentially shifting a roller to achieve proper registration with other in-line web-contacting rollers in the press.

2. Description of the Prior Art

Traditionally, complete web-fed offset lithographic printing presses are composed of a series of aligned stations or towers through which a continuous web of paper is fed for printing and handling purposes. In the case of color printing for example, a separate printing tower is used for each color so as to give the final printed material a multi-color effect. In addition, a complete press may include numbering and/or punching units, as well as slitting and folding devices.

Printing presses are generally either of the hard impression cylinder or perfecting variety. A hard impression press includes one or more printing towers each including a pair of web-receiving rollers, i.e., a printing roller and hard impression roller arranged to present a web-receiving nip therebetween. Printing with this type of apparatus is on one side of the web only. Perfecting presses on the other hand are designed for simultaneously printing on both faces of a moving web. To this end, the towers of a perfecting press include a pair of adjacent blanket rollers designed to receive the web therebetween and to print on both faces thereof. Each web has an associated plate cylinder for transferring the image to be printed onto the associated blanket roller.

As those skilled in the art will readily appreciate, an extremely important feature in connection with multiple-station web printing and handling equipment is that proper registration be maintained between respective stations. For example, in the case of multi-color printing wherein each successive printing tower prints a separate color, it is all important that precise registration be maintained so that blurring and overlapping of the successively printed images be avoided. Accordingly, a number of proposals have been made in the past for circumferential adjustment of one or more rollers in a given press tower or station relative to the rollers in separate towers, and, in the case of a perfecter unit, relative to other rollers in the same unit. Generally speaking, prior mechanisms for such circumferential adjustment have been quite intricate, and moreover require a considerable degree of operator skill. Many such units demand manual operation, and are limited in their ability to circumferentially adjust a roller (often referred to in the art as phase adjustment or change) only through an arc of a few degrees. Accordingly, both the accuracy and range of utility of such prior devices are limited.

Prior printing presses have employed harmonic phasing devices without utilizing the advantages of the 1:1 harmonic drive differential. For example, in U.S. Pat. No. 3,724,368, the harmonic drive input member has a predetermined number of internal gear teeth and the output member has a number of external gear teeth less than the predetermined number of internal gear teeth on input member; compensation for the difference in number of gear teeth is needed outside of the harmonic drive unit, so that the plate cylinder is rotated at the surface speed of blanket cylinder.

It has heretofore been suggested that so-called harmonic or sine wave gears be adapted to the adjustment of phase relationships between printing rollers. Harmonic gearing is described in U.S. Pat. No. 2,906,143 to C. W. Musser, U.S. Pat. No. 3,565,006 to Stewart, and in an advertizing brochure distributed by the United Shoe Machinery Corporation entitled "Harmonic Drive Pancake Gearing", HDUF 13000-76. All of the aforementioned are incorporated by reference herein. Generally speaking however, a harmonic drive gear includes a rotatable, elliptical wave generator, along with a flexible, toothed, rotatable spline disposed about the wave generator, and first and second rigid, annular, internally toothed, rotatable splines about the flexible spline and located for engagement therewith. One of the rigid splines is generally referred to as a dynamic spline, and has the same number of teeth as the flexible spline. The other rigid spline is referred to as the circular spline, and has a greater number, e.g., two, of teeth than the flexible spline. In operation, rotation of the wave generator results in a continuously moving wave form transferred to the surrounding flexible spline, and thence to the outermost rigid splines.

It has also been suggested in the past to employ a pair of harmonic drive gears mounted in adjacent, intercoupled relationship as a 1:1 transmission and phase changing differential. In such propsals, the tandem harmonic drive gear components are of the same size and ratio. Moreover, one of the wave generators is held fixed, whereas the other wave generator is selectively rotatable for phase changing purposes.

Prior patents of background interest to the instant invention include, in addition to the foregoing referenced patents, U.S. Pat. Nos. 3,218,696, 1,590,742, 1,320,358, 2,248,926, 3,511,179, 2,949,851, 3,073,997, 2,301,379, and 3,525,305.

SUMMARY OF THE INVENTION

Broadly speaking, the present invention is concerned with a web handling station such as a printing tower or other device such as found in an in-line, web-fed printing press. The web handling station includes a pair of elongated, axially rotatable rollers cooperatively defining a web-receiving and handling nip therebetween, along with first motive means for rotation of the rollers. A transmission and phasing apparatus also forms a part of the station, and serves to couple the first motive means and nip-defining rollers for driving of the latter, and also includes structure for selectively changing the phase or circumferential position of at least one of the rollers.

The transmission and phasing apparatus is provided with a phasing device having first and second rotatable, coaxial, side-by-side harmonic drive gears therein. The drive gears are of known construction and include a central, elliptical wave generator, a flexible, toothed, rotatable spline disposed about the wave generator, and a first, rigid, rotatable toothed spline about the flexible spline and located for engagement with the latter. A second rigid rotatable spline is in bridging disposition to the harmonic drive gears and is disposed for simultaneous meshing engagement with the flexible spline of each harmonic gear. A second motive means preferably in the form of a stepper motor is operably coupled to the wave generator of one of the harmonic gears for selective phase alteration of the desired roller. Finally, drive input structure is operably coupled to a rigid spline of one of the harmonic drive gears, whereas the drive output structure is coupled to a rigid spline of the remaining harmonic gear.

The device of the present invention is usable in connection with either hard impression or perfecter printing towers. In the case of a hard impression tower, the transmission and phasing apparatus is coupled to the plate roller for selective alteration of the circumferential position thereof, whereas in the case of a perfecter tower, separate phasing and transmission devices are employed and are operatively coupled to the corresponding plate cylinders. In this fashion, the upper and lower plate cylinders can be individually or separately shifted for phase changing purposes.

DESCRIPTION OF THE PREFERRED EMBODIMENTS

Figure 1:
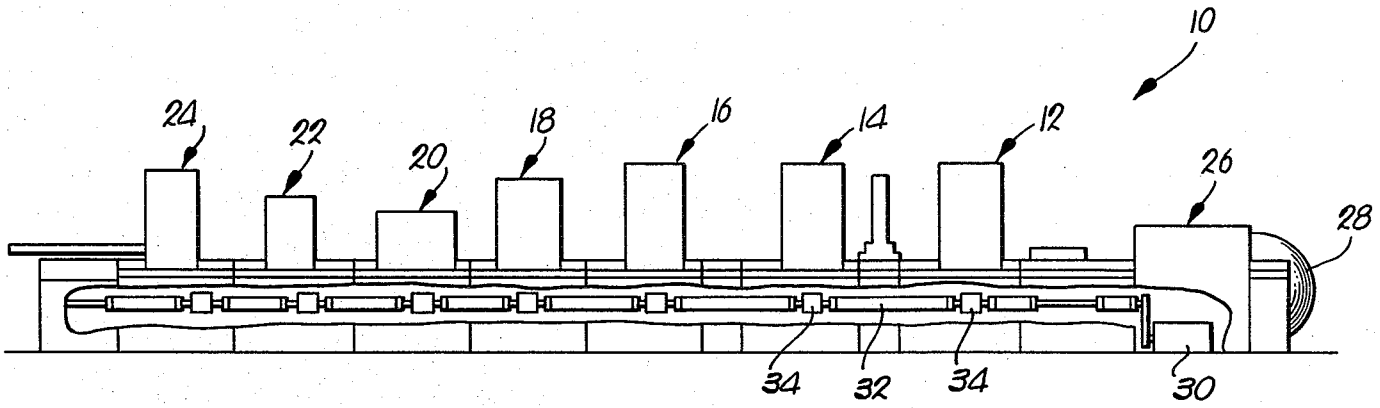
FIG. 1 is an essentially schematic side view with parts broken away for clarity of an in-line, multiple-station, web-fed hard impression cylinder printing press.

Turning now to the drawings, FIG. 1 illustrates an in-line, multiple-station, web-fed hard impression printing press 10. The press 10 is provided with three separate printing towers 12, 14 and 16, as well as downstream web handling stations including a numbering unit 18, a punch 20, a slitter-perforater 22, and a folder 24. The press 10 is also equipped with a roll stand 26 designed to hold a continuous roll of web material 28. A press drive motor 30 is also provided, along with a continuous drive line 32 operatively coupled to motor 30 and extending along the length of press 10. A gear box 34 is interposed in the drive line 32 at each printing tower and station for driving thereof.

Figure 2:
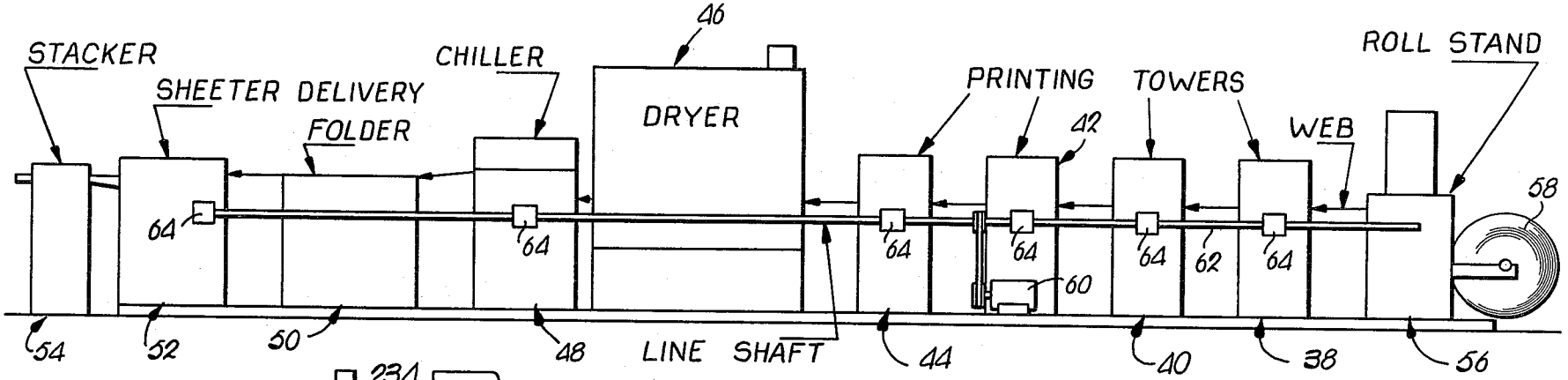
FIG. 2 is a view similar to that of FIG. 1 and illustrates an in-line, multiple-station, web-fed perfecter printing press.

FIG. 2 is a schematic illustration of a multiple-station, in-line, web-fed perfecter printing press 36. The press 36 is in many respects similar to press 10 and includes four tandem oriented perfecter printing towers 38, 40, 42 and 44. Downstream web handling station include a dryer 46, chiller 48, folder 50, sheeter 52 and stacker 54. Here again, a roll stand 56 is provided for supporting a roll of continuous web material 58 which is passed in serial order through the printing towers and downstream equipment, as those skilled in the art will readily appreciate. A motor 60, and an elongated, conventional drive line 62 also form a part of press 36. Respective gear boxes 64 are interposed in line 62 adjacent the perfecter printing towers 38–44, and sheeter 52, as illustrated.

Referring again to the hard impression printing towers 12–16 of FIG. 1, it will be understood that each such tower includes a pair of elongated, axially rotatable rollers which cooperatively define a web-receiving and printing nip. In particular (see FIG. 3), each tower includes a plate roller 66, a blanket roller 67, and an adjacent impression roller 68. The rollers are mounted for axial rotation between spaced sidewalls, one of which is illustrated in phantom in FIG. 3 and denoted by the numeral 70. Connection between the roller 66, 67, and 68 and motor 30 is effected through drive line 32, the associated gear box 34, and a transmission and phasing apparatus broadly referred to by the numeral 72. Apparatus 72 serves to transmit driving power from line 32 and gear box 34 to impression roller 68; and the latter is drivingly connected by gears (not shown) to the blanket roller 67 and plate roller 68. In addition, the apparatus 72 permits selective circumferential rotation of the plate roller 66 in the manner to be explained.

Generally speaking, the apparatus 72 includes a phasing device 74 having a pair of tandem coupled harmonic drive gears later to be described and disposed within housing 76, along with selectively operable motive means preferably in the form of a stepper motor 78 operably coupled with one of the harmonic drive gears. Drive input structure 80 also forms a part of the overall apparatus 72 and serves to operatively couple the tandem gear set with the gear box 34, line 32 and motor 30. Drive output structure 82 is also provided for the purpose of coupling the roller 66 and the tandem gear set.

Figure 7:
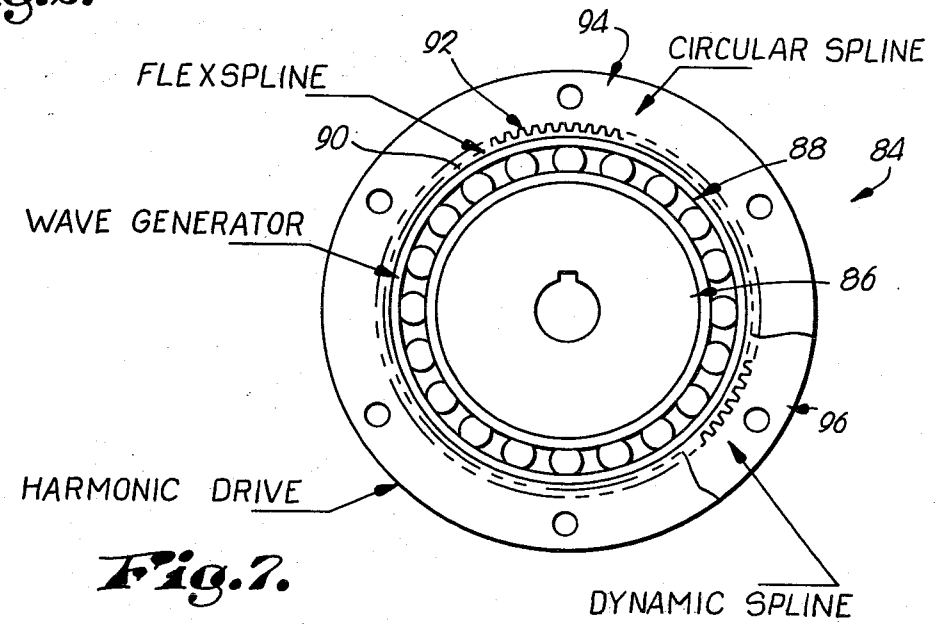
FIG. 7 is a side view of a harmonic drive "pancake" gear used in the phasing devices of the present invention.

Referring to FIG. 7, a conventional harmonic drive gear 84 is illustrated. The gear 84 includes a central, apertured, elliptical wave generator 86 having outer peripheral ball bearings 88, along with a thin, metallic flexible spline 90 disposed thereabout. The spline 90 is externally toothed as at 92. The gear 84 further includes a pair of side-by-side, annular, internally toothed splines. The so-called circular spline 94 has more teeth than the adjacent flexible spline 90, in this case, two more teeth. Dynamic spline 96 on the other hand has the same number of teeth as the flexible spline 90. It will further be observed that the internal teeth on the rigid splines 94, 96, are disposed for meshing interengagement with the external teeth on flexible spline 90. Inasmuch as harmonic drive gear 84 is known, a detailed description of the construction and operation thereof is unnecessary. However, further details in these respects may be obtained from the above referenced patents and publication incorporated by reference herein.

Figure 5:
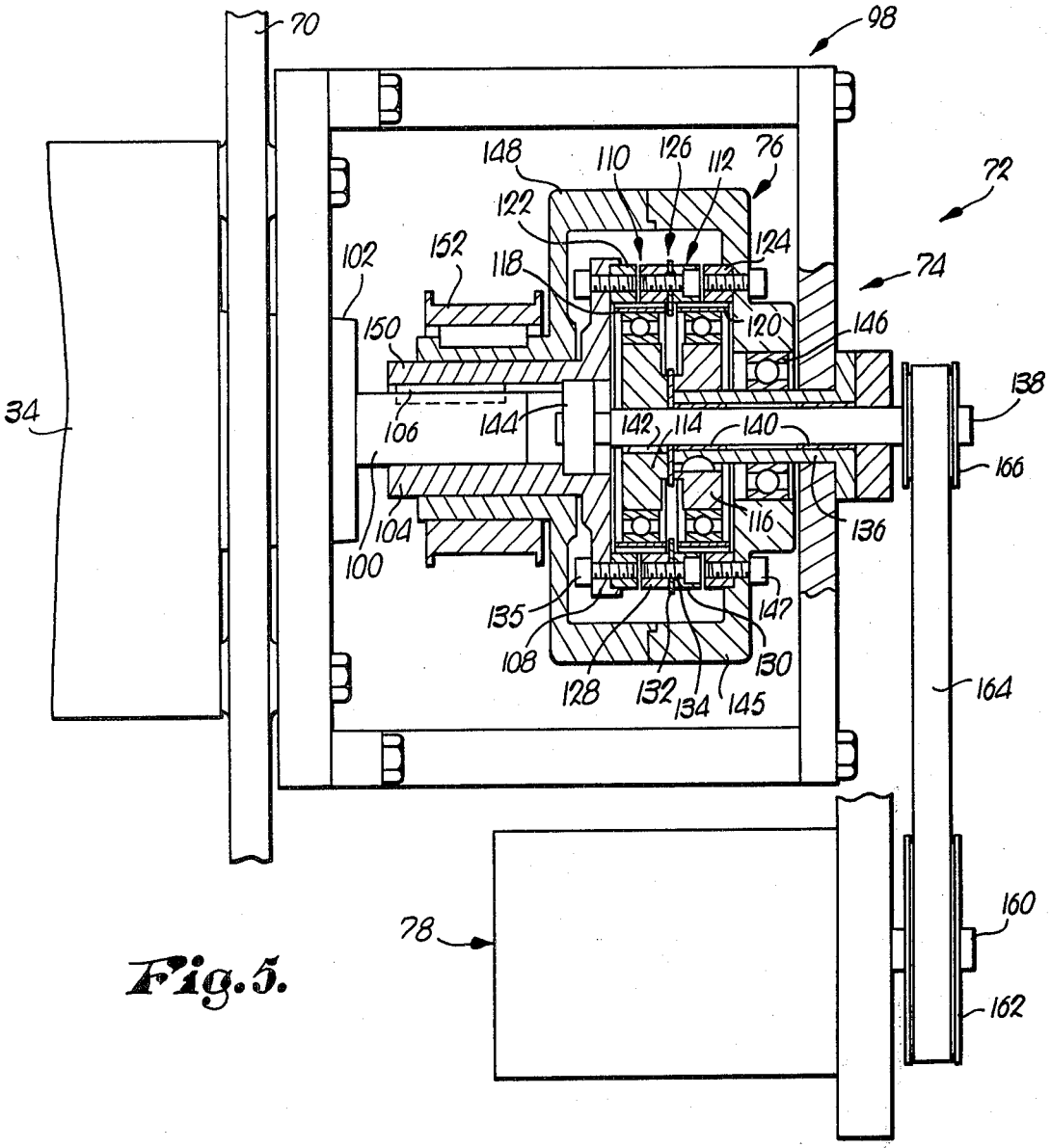
FIG. 5 is a fragmentary view in partial vertical section depicting the internal construction of a phasing device especially designed for use on a hard impression cylinder printing tower.

Referring now to FIG. 5, the details of construction of transmission and phasing apparatus 72 will be explained. First of all, it is to be understood that the apparatus 72 is mounted on plate 70 by means of a conventional support frame 98 adjacent the associated gear box 34. An elongated, axially rotatable output shaft 100 from gear box 34 extends through plate 70 and appropriate bearing structure 102. The drive input for phasing device 74 is in the form of an elongated collar 104 keyed to shaft 100 as at 106 and provided with a radial flange 108.

The device 74 further includes a pair of coupled harmonic drive gears 110 and 112 which are located in juxtaposed, coaxial relation. Each of the gears 110, 112, includes a central, elliptical wave generator 114, 116, a flexible, externally toothed spline 118, 120, and a first, rigid, internally toothed outboard spline 122, 124 located for meshing interengagement with a corresponding flexible spline 118, 120. A second, rigid, internally toothed, inboard spline 126 is provided in bridging engagement between the respective gears 110, 112, and is disposed such that the internal teeth thereof are simultaneously engageable with the flexible splines 118, 120. As depicted in FIG. 5, the spline 126 is in the form of a pair of rigid splines 128, 130 separated by a spacer 132 and interconnected by means of a series of screws 134. Thus, the splines 128, 130, rotate in unison. It will further be observed that outboard spline 122 is coupled to flange 108 by means of screws 135, so that these elements rotate in unison.

Wave generator 116 is fixedly keyed to a stationary annular sleeve 136, the later being fixed to frame 98 as illustrated. An elongated, trim shaft 138 extends through sleeve 136 and is axially rotatably supported therein on spaced bearings 140. Wave generator 114 is fixed to trim shaft 138 by means of key 142. The innermost end of the shaft 138 is rotatably supported by means of roller bearing 144 mounted within the collar 104.

Figure 3:
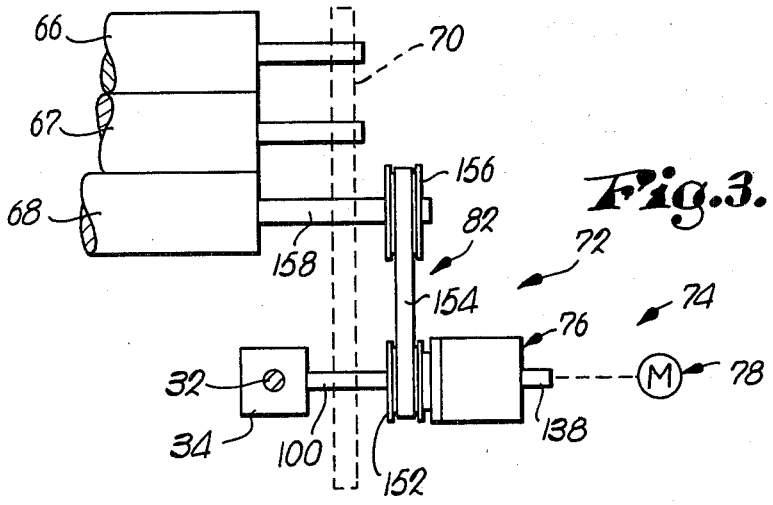
FIG. 3 is a fragmentary, essentially schematic depiction of the plate, blanket, and impression rollers of a hard cylinder printing tower, with the transmission and phasing apparatus of the present invention mounted thereon.

The output drive of device 74 includes a first annular housing section 145 which is fixedly secured to outboard spline 124 by screws 147 and is rotatably supported on bearing structure 146. The output drive also has a second housing section 148 secured to section 145 for rotation therewith. The section 148 includes a tubular portion 150 disposed about and rotatable with respect to collar 104. Finally, a pulley 152 is keyed to the portion 150 by conventional means. Referring to FIG. 3, it will be seen that a belt 154 is trained about pulley 152, and also about another drive pulley 156 fixed to shaft 158. Shaft 158 in turn is coupled to impression roller 68 for powered rotation of the latter.

Stepper motor 78 includes the usual output shaft 160 having a drive pulley 162 secured thereto. A drive belt 164 is trained about pulley 162, and about an upper pulley 166 affixed to the outermost end of trim shaft 138.

During normal running operation of the printing tower or other web handling station, the apparatus 72 serves as a normal power transmission. Specifically, during this mode of operation, output rotation of gear box shaft 100 correspondingly rotates the collar 104 and thereby the outboard rigid spline 122. This serves to transfer torque through the flexible spline 118 and rigid spline 126 to flexible spline 120 and to outboard rigid spline 124. This in turn serves to rotate the housing sections 144 and 148, thus rotating pulley 152, belt 154, pulley 156, shaft 158 and roller 66. Inasmuch as the gear ratios of the respective harmonic gears 110 and 112 are identical, the apparatus 72 serves as a 1:1 ratio transmission during normal operation, and this serves to maintain proper registration (once achieved) between separate stations.

When it is desired to change the circumferential position or phase of the rollers 66, 67, and 68, stepper motor 78 is actuated to thereby rotate trim shaft 138 in a desired direction. This serves to rotate wave generator 114 and flexible spline 118 in accordance with operation of the harmonic gear 110, so that inboard spline 126 is correspondingly advanced or retracted as desired. This serves to in turn advance or retract flexible spline 120, along with outboard spline 124 and the drive output structure associated with the latter. Ultimately, the rollers 66, 67, and 68 are circumferentially advanced or retracted relative to other rollers in the overall press a distance proportional to the distance of rotation of trim shaft 138.

Figure 4:
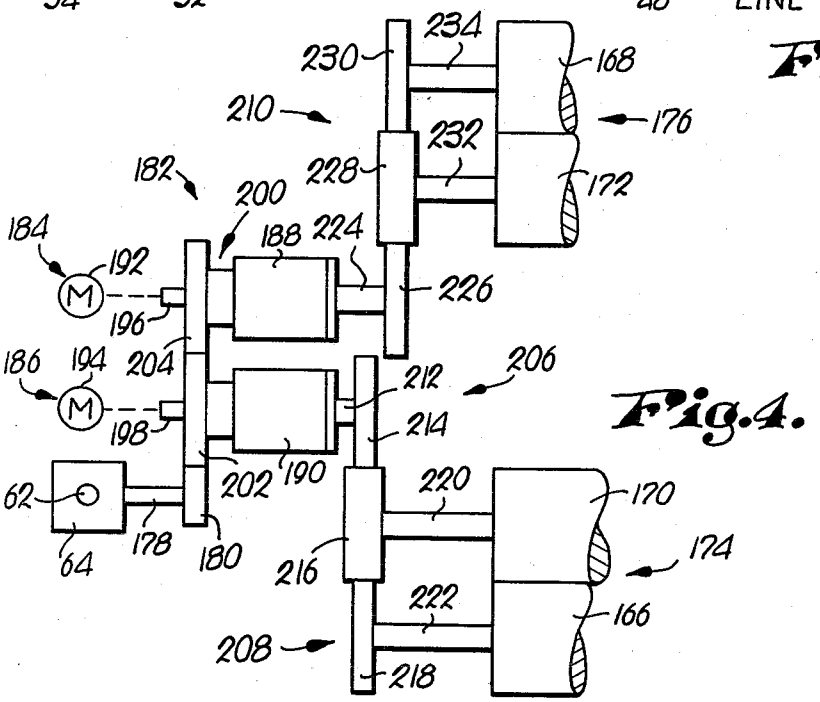
FIG. 4 is a view similar to that of FIG. 3 and illustrates the respective plate and blanket roller sets of a perfecter printing tower, with the preferred transmission and phasing apparatus of the invention coupled thereto.

FIG. 4 is a schematic representation illustrating the drive arrangement of one of the printing towers 38–44. That is to say, each tower includes a pair of elongated, axially rotatable blanket rollers 166, 168, along with an adjacent, elongated, axially rotatable plate roller 170, 172, thereby presenting two blanket-plate roller sets 174, 176. In the normal configuration of a perfecter printing tower, the respective blanket rollers of each set are in adjaceny to present a web-receiving nip; however, in order to best illustrate the drive arrangement, the respective sets are shown in separated relation in FIG. 4. In any event, it will be seen that the gear box 64 is provided with an elongated, axially rotatable output shaft 178 having a gear 180 secured to the outermost end thereof. Transmission and phasing apparatus 182 is operatively coupled to gear 180 and to the respective blanket-plate sets 174, 176.

Specifically, the apparatus 182 includes separate phasing devices 184, 186, each including a pair of coupled harmonic drive gears later to be described disposed within associated housings 188, 190. A stepper motor 192, 194 is operatively coupled to one of the harmonic drive gears in each set thereof through respective trim shafts 196, 198. Drive input structure 200 for the devices 184, 186, include a pair of gears 202, 204 in meshed interengagement and respectively coupled to the associated harmonic drive gears of the individual devices 184, 186. It will be noted in this respect that gear 180 is further in meshed interengagement with gear 202 for driving of the latter and gear 204.

Drive output structure 206 forming a part of overall apparatus 182 is in the form of separate drive trains 208, 210 which respectively operably couple each of the rollers of the sets 174, 176 and the associated harmonic drive gear phasing device. The train 208 includes a shaft 212, a first gear 214 secured to the shaft 212, a second gear 216 in meshed interengagement with gear 214, and a third gear 218 in engagement with gear 216. A shaft 220 is coupled to gear 216 for powered rotation of plate roller 170, whereas the shaft 222 is coupled to gear 218 for driving of blanket roller 166.

Drive train 210 is very similar and includes shaft 224, along with first, second and third gears 226, 228 and 230 as illustrated. A shaft 232 is secured to gear 228 for powered rotation of plate roller 172, whereas a shaft 234 extends between gear 230 and blanket roller 168 for a similar purpose. As in the case of train 208, the gears 226, 228, and 230 are in meshed, driving engagement.

Figure 6:
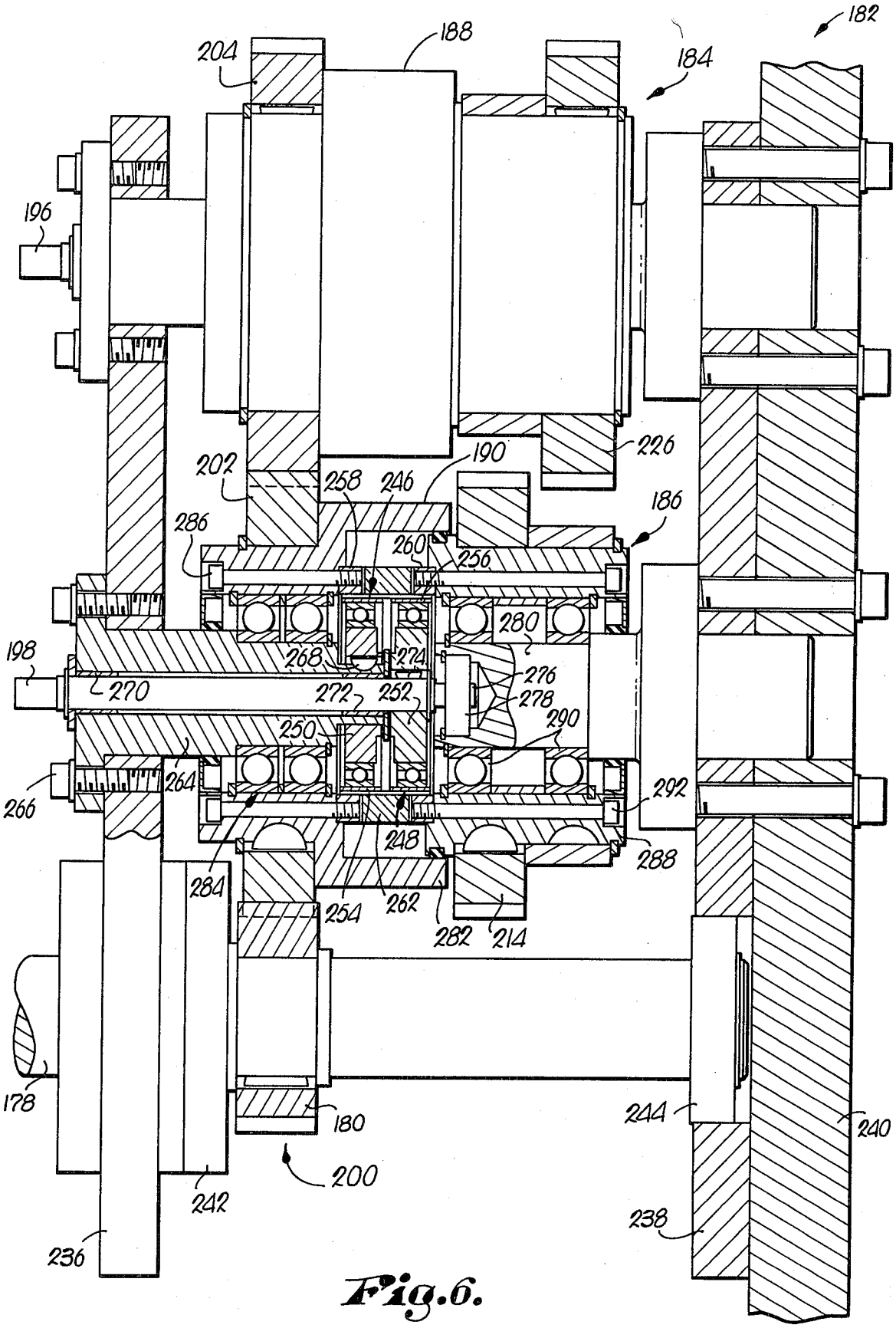
FIG. 6 is a fragmentary view in partial vertical section depicting the internal construction and arrangement of the phasing devices associated with a perfector printing tower.

The details of construction of the phasing devices 184, 186 are best illustrated in FIG. 6. Inasmuch as these devices are essentially identical, the internal construction of 186 only has been depicted, and the ensuing description will be limited to this device as well. At the outset however, it should be understood that the respective phasing devices 184, 186, are mounted between a pair of spaced apart mounting plates 236, 238, with the latter being mounted on a tower sidewall 240. The gear box shaft 178 extends through plate 236 and is rotatably supported on bearing structure 242, with the remote end of the shaft 178 being supported by a roller bearing 244 suitably mounted in plate 238. Input drive gear 180 is keyed to shaft 178, and is in driving engagement with the mated gears 202, 204, as explained in connection with FIG. 4. Further, although not specifically illustrated in FIG. 6, it will be understood that respective stepper motors 192, 194 are operatively and drivingly coupled to the associated trim shafts 196, 198. Finally, only the gears 214 and 226 of the respective trains 208, 210, have been illustrated in FIG. 6.

The device 186 includes a pair of coupled harmonic drive gears 246 and 248 located in juxtaposed, coaxial relationship. Each gear 246, 248, includes a central, elliptical wave generator 250, 252, a flexible, externally toothed spline 254, 256, and a first, rigid, internally toothed outboard spline 258, 260, located for meshing interengagement with a corresponding flexible spline 254, 256. A second, rigid, internally toothed inboard spline 262 is provided in bridging engagement between the respective gears 246, 248, and is disposed such that the internal teeth thereof are simultaneously engageable with the spaced flexible splines 254, 256. As depicted in FIG. 6, the spline 262 is in the form of an integral, annular, internally toothed member.

The device 186 further includes a flanged sleeve 264 mounted on plate 236 by means of screws 266. It will be observed that wave generator 250 of gear 246 is keyed to the stationary sleeve 264, as at 268. Further, trim shaft 198 extends through the bore of sleeve 264 and is rotatably supported therein on spaced bearings 270. Wave generator 252 forming a part of gear 248 is keyed to the inner end of shaft 198 as at 274, for rotation with the trim shaft. An extension 276 of the trim shaft is rotationally supported on a roller bearing 278, the latter being located within an elongated stub shaft 280 fixed to sidewall 240 and plate 238.

Drive input gear 202 is keyed to annular, axially rotatable housing section 282 which is in turn rotationally supported on bearing structure 284. As illustrated, the structure 284 is mounted on stationary sleeve 264. Further, it will be seen that rotatable housing section 282 is fixed to outboard rigid spline 258 by means of screws 286, so that the housing section and outboard spline rotate in unison.

Output gear 214 is keyed to an annular collar 288 disposed about shaft 280. The collar is supported by respective spaced apart bearing sets 290 which are in turn mounted on stub shaft 280. Further, the collar 288 is fixed to outboard spline 260 by means of screws 292, so that the spline 256 and collar 288 rotate in unison.

As noted above, the devices 184 and 186 are essentially identical in construction and operation. In this connection it will be observed that the drive output gear 214 associated with device 186 is offset from gear 226 of device 184; this is for the purpose of positioning the respective drive trains 208, 210 in non-interfering positions with respect to one another. In all other details, the devices 184, 186 are identical.

The operation of the harmonic devices of FIG. 6 is identical with that described above in connection with device 74. That is to say, during normal running operation the devices 184, 186 serve as simple one-to-one gear ratio differentials for power transmission purposes. Further, the respective devices 184, 186 can be operated in a phase changing mode either in unison or singly. Such operation is exactly as described above with device 74, and need not be again discussed in detail. In the former case both plate-blanket sets 174, 176 are circumferentially adjusted relative to other rollers in separate press stations, whereas in the latter case one plate-blanket set is adjusted relative to the other in a single printing tower or station.

In practice, the stepper motors associated with the phasing devices of the present invention are coupled to a digital read out device, so as to enhance operator control and the accuracy of phase alterations. Such devices and connections to the stepper motors are well known, and need not be described in detail herein. Further, the nature of the harmonic devices permits either static or dynamic phase alterations over a full 360 degrees of travel. Thus, during setup and/or operation of a given in-line press, the operator can make major or minor phase changes as needed to establish or maintain proper registration. This can be accomplished with a high degree of accuracy, and without the considerable degree of manipulative skill and experience which has heretofore been required.

The 1:1 gearing ratio of the harmonic drive phasing unit hereof and the 1:1 gearing ratio of plate and blanket gears provide excellent repeatable registration of plate to blanket cylinder positioning. Only possible tooth-to-tooth gear errors prevent this system from obtaining mechanically exact register between these cylinders. High quality printing requires registration within a few thousandths of an inch. When other than 1:1 ratio gearing is used between the plate and blanket cylinders or between printing nips, other errors in registration are present. Total composite errors, eccentricities of gears and cylinders, and part runouts exist and show up in printing with non-repeating gear ratios (see, e.g., U.S. Pat. No. 3,724,368). In addition, the 1:1 harmonic drive differential used in the present invention as a phasing device is readily adaptable to any press circumference size.

Having thus described the invention, what is claimed as new and desired to be secured by Letters Patent is:

1. A web-handling station, comprising:

a pair of elongated, axially rotatable rollers;

first motive means for rotation of said rollers;

transmission and phasing apparatus for coupling said first motive means and said rollers, and for selectively changing the phase of at least one of said rollers, including a 1:1 gear ratio phasing device having first and second, rotatable, coaxial, juxtaposed harmonic drive gears each including an elliptical wave generator, a flexible, toothed, rotatable spline disposed about said wave generator, and a first-rigid, rotatable toothed spline about said flexible spline and for engagement therewith;

a second, rigid rotatable spline briding said first and second harmonic gears and disposed for simultaneous meshing engagement with the flexible spline of each harmonic gear;

selectively operable second motive means; and means coupling said second motive means and the wave generator of one of said harmonic gears for rotation of the coupled wave generator to effect said phase change upon operation of said second motive means, including means for selectively and intermittently operating said second motive means only in response to the need to effect said phase change, and for maintaining said coupled wave generator stationary during normal rotation of said rollers;

drive input structure operatively coupling said first motive means and the first spline of one of said harmonic gears; and drive output structure operatively coupling said one roller and the first spline of the other of said harmonic gears, including first and second gears respectively secured to said rollers, said first and second gears being in meshed, driving engagement and having a gearing ratio for driving said rollers at the same surface speed.

2. The station as set forth in claim 1, said second motive means comprising a stepper motor.

3. The station as set forth in claim 1, said one roller being a blanket roller, the other of said rollers being an impression roller.

4. The station as set forth in claim 2, said drive output structure including a belt drive.

5. The station as set forth in claim 1, said rollers being blanket rollers for printing onto both faces of a web simultaneously, there being a separate elongated rotatable plate roller in tangential rolling contact with each blanket roller respectively to form two blanket-plate roller sets, said transmission and phasing apparatus including a separate phasing device for each of said sets respectively for changing the phase of each set, said drive input structure being operatively coupled to the first splines of one of said harmonic gears of both of said phasing devices, said drive output structure comprising separate drive trains respectively operatively coupling each of the rollers of said roller sets to the first spline of the other associated phasing device.

6. The station as set forth in claim 5, said drive trains each comprising drive gearing.

7. The station as set forth in claim 1, said second spline comprising a pair of rigid toothed splines secured for rotation thereof in unison.

8. The station as set forth in claim 1, said second spline being an integral member.

* * * * *